US007021979B2

(12) United States Patent
Yazaki et al.

(10) Patent No.: US 7,021,979 B2
(45) Date of Patent: Apr. 4, 2006

(54) OUTBOARD MOTOR

(75) Inventors: Makoto Yazaki, Wako (JP); Toyoshi Yasuda, Wako (JP); Mitsuaki Kubota, Wako (JP); Shinichi Ide, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/839,431

(22) Filed: May 5, 2004

(65) Prior Publication Data

US 2004/0229528 A1 Nov. 18, 2004

(30) Foreign Application Priority Data

May 13, 2003 (JP) ..... 2003-135036

(51) Int. Cl.
*B63H 21/10* (2006.01)

(52) U.S. Cl. ..... 440/88 A; 440/77

(58) Field of Classification Search ..... 440/77, 440/88 A, 88 R

See application file for complete search history.

(56) References Cited

U.S. PATENT DOCUMENTS

| | | | | |
|---|---|---|---|---|
| 4,379,702 | A * | 4/1983 | Takada et al. | 440/77 |
| 4,403,971 | A * | 9/1983 | Kobayashi et al. | 440/88 R |
| 5,052,960 | A | 10/1991 | Kato | 440/77 |
| 6,099,371 | A * | 8/2000 | Nozawa et al. | 440/77 |
| 6,132,273 | A * | 10/2000 | Nakayama et al. | 440/77 |

FOREIGN PATENT DOCUMENTS

| | | |
|---|---|---|
| JP | 4166496 | 6/1992 |

* cited by examiner

*Primary Examiner*—Lars A. Olson
(74) *Attorney, Agent, or Firm*—Adams & Wilks

(57) ABSTRACT

An outboard motor having an intake passage unit for introducing air into an engine compartment is provided. The intake passage unit has two intake passage portions disposed at the left and the right of an engine, extending vertically, to reduce the fore-and-aft length of an engine cover. The left and right intake passage portions communicate at their upper portions with air introduction openings formed in the engine cover.

10 Claims, 10 Drawing Sheets

OUTBOARD MOTOR

FIELD OF THE INVENTION

The present invention relates to outboard motors, and more particularly, to the structure of an intake passage for introducing air into an engine compartment so that the air is taken into an engine covered by an engine cover.

BACKGROUND OF THE INVENTION

An outboard motor is a propulsion machine for propelling a boat by rotating a propeller mounted to a stern by the drive of an engine. The engine is covered by a cover for water-tightness.

In order to prevent water from being mixed into an intake air to be taken into an engine, means for preventing water from entering through an air introduction portion of a cover and means for separating water from air have been devised. For example, a barrier for preventing ingress of water is provided midway along an intake passage, or an intake passage is provided such that only an intake air flows up to prevent entering of water, or an intake passage is bent to deflect the ingress direction of water so as to separate water from air.

When a required amount of intake air of an engine is larger, an intake passage needs a correspondingly larger opening area. The presence of the intake passage in the engine compartment, however, greatly affects the external dimensions of an engine cover.

An outboard motor with an intake passage provided along the rear and the side of an engine in an engine cover as an intake passage for introducing air into an engine compartment of the outboard motor is disclosed, for example, in Japanese Patent Laid-Open Publication No. HEI-4-166496.

In this outboard motor, an intake chamber communicating with an intake section of the engine is provided in such a manner as to vertically extend on one side within the engine compartment. In the engine compartment, an intake duct for introducing air from an air intake provided in the engine cover on the other side of the engine compartment into the intake chamber is provided in such a manner as to go around the rear of the engine.

The intake passage is configured with a single intake duct, thus having a large vertical section area or horizontal section area. The disposition of the passage of a large section area along the rear and the side of the engine results in a large contour of the engine cover for avoidance of its interference with the engine and auxiliary machinery around the engine. That is, the fore-and-aft dimension of the engine cover is increased, and also the lateral dimension of the engine cover is increased. Thus, the contour of an engine cover portion constituting an upper half of the outboard motor is enlarged in fore-and-aft and transverse directions.

When the outboard motor with the contour of the engine cover enlarged fore and aft, which is mounted tiltable to the stern of a hull, is rotated upward about a tilt shaft, the path of the outermost portion expands radially about the tilt shaft, being unsuitable for the hull. Consequently, when choosing an outboard motor, the range of choices is narrowed.

It is thus desired to ensure a necessary and sufficient amount of air intake of an engine without greatly affecting the external dimensions of an outboard motor.

SUMMARY OF THE INVENTION

According to the present invention, there is provided an outboard motor which comprises an engine; an engine cover defining at least a part of an engine compartment housing the engine, the engine cover having at least one air introduction opening for taking air into the engine compartment; and an intake passage unit provided within the engine cover and having left and right passage portions communicating with the air introduction opening and extending vertically in a rear half portion of the engine compartment; wherein, the left and right passage portions overlap the engine in a side view, and rear edges of the left and right passage portions are located forward of a rear inner surface of the engine cover.

In the outboard motor of this invention, the two passage portions disposed on the left and the right of the engine can ensure a necessary and sufficient amount of intake air while reducing the fore-and-aft length of the engine cover. As a result, the fore-and-aft dimension of the engine cover determining the fore-and-aft length of the outboard motor can be reduced. When the outboard motor tilts, the rotation path of the outermost portion of the outboard motor is prevented from being enlarged radially to fit well with a hull, resulting in an increased range of choices of outboard motors.

In this invention, the rear edge of one passage portion of the left and right passage portions is preferably located forward of a rear edge of the engine so as to make the fore-and-aft dimension of the engine cover smaller.

The left and right passage portions are preferably in vertically extending tubular shapes and connected at upper portions to the air introduction opening in a communicating manner. The two passage portions thus become a single component, facilitating assemblage.

Plane cross sections of the left and right passage portions preferably have flat shapes elongated in a fore-and-aft direction of the engine cover. The passage portions thus have smaller widths, resulting in a reduced width dimension of the engine cover and a smaller contour of the outboard motor.

The engine is preferably an in-line engine with centerlines of cylinders oriented in a for introduction opening for taking e-and-aft direction. The in-line engine with the cylinders arranged above and below facilitates the arrangement of the left and right passage portions at the sides of the engine.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
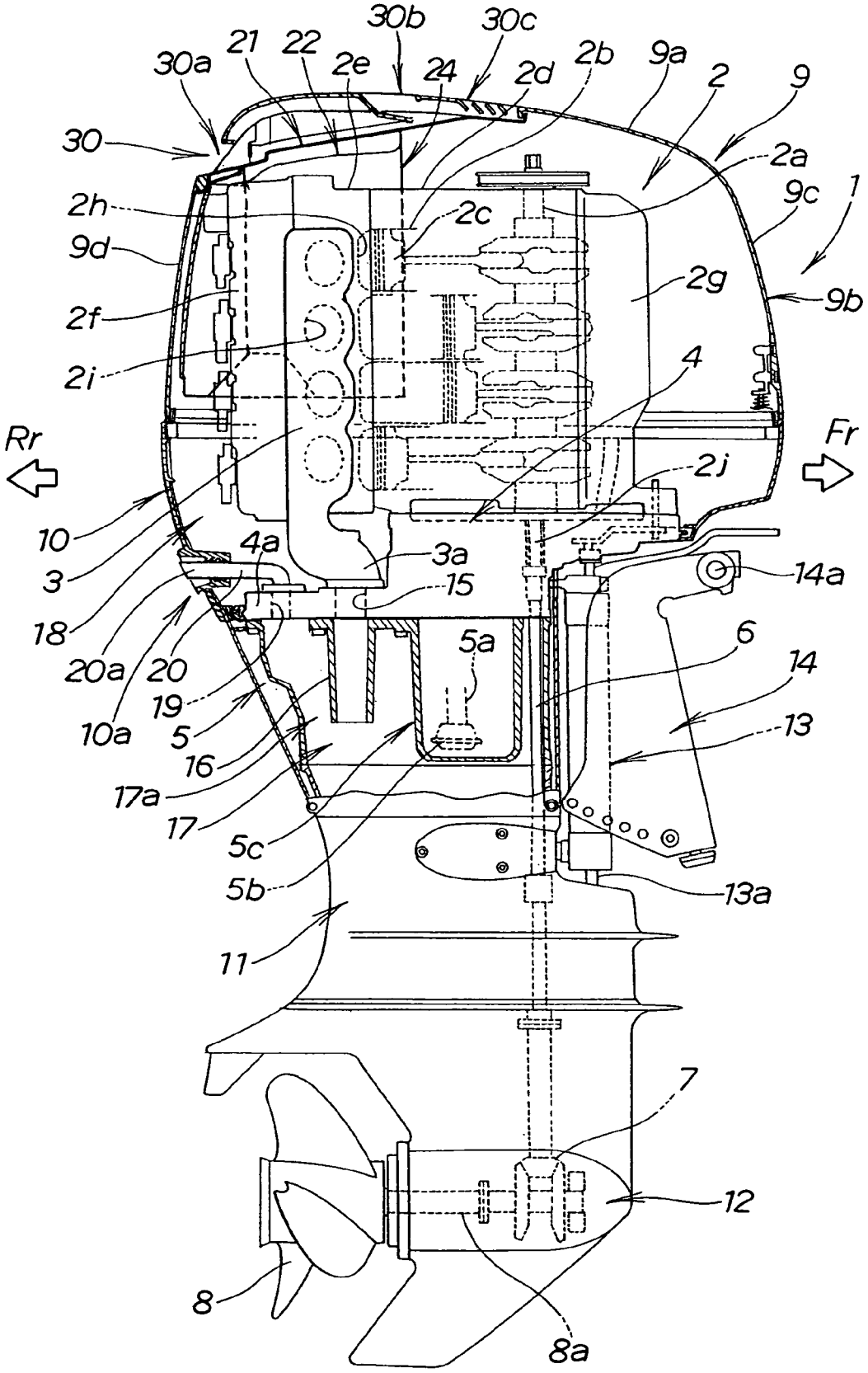
FIG. 1 is a cross-sectional view of an outboard motor according to the present invention.

In FIG. 1, reference signs Fr and Rr denote fore-and-aft directions of an outboard motor 1.

The outboard motor 1 includes a mount case 4 supporting an engine 2, and an engine cover 9 covering the engine 2 and defining an engine compartment 18.

The engine 2 is a vertical engine with a crankshaft 2*a* oriented vertically. The engine 2 is a 4-cylinder engine having a cylinder block 2*d* disposed in a fore and aft intermediate position in the outboard motor 1, and four cylinders 2*b*, 2*b*, 2*b*, 2*b* arranged above and below in parallel.

The four cylinders 2*b* of the engine 2 are provided with pistons 2*c*, 2*c*, 2*c*, 2*c*, respectively. The centerline of each cylinder 2*b* is oriented in a fore-and-aft direction of the outboard motor 1.

A cylinder head 2*e* is provided at the rear of the cylinder block 2*d*. A cylinder head cover 2*f* is provided at the rear of the cylinder head 2*e*. A crankcase 2*g* is disposed at the front of the cylinder block 2*d*. The cylinder block 2*d*, cylinder head 2*e*, cylinder head cover 2*f* and crankcase 2*g* constitute an engine assembly. The engine assembly is supported by the mount case 4 on an oil case 5. An oil pump body is provided below the engine 2.

Combustion chambers 2*h*, 2*h*, 2*h*, 2*h* of the engine 2 are formed by the cylinders 2*b*, 2*b*, 2*b*, 2*b*, pistons 2*c*, 2*c*, 2*c*, 2*c* and cylinder head 2*e*.

The combustion chambers 2*h* communicate with their respective exhaust ports 2*i* provided in the cylinder head 2*e*. An exhaust manifold 3 is provided vertically, laterally outside the cylinder head 2*e* so as to correspond to the exhaust ports 2*i*.

The oil case 5 has an oil pan 5*c* and an exhaust chamber 17*a* to be described below. An oil suction pipe 5*a* and an oil strainer 5*b* are housed in the oil pan 5*c*.

The mount case 4 serves as a partition between the engine compartment 18 and a chamber 17 located below.

The crankshaft 2*a* is located in a forward portion of the outboard motor 1 on the right in FIG. 1.

A lower end portion of the crankshaft 2*a* is connected to an output shaft 2*j* via a flywheel (not shown). The output shaft 2*j* vertically passes through the mount case 4 and is connected to an upper end portion of a drive shaft 6 coaxial with the output shaft 2*j*.

The drive shaft 6 extends vertically downward through the chamber 17 and between the oil pan 5*c* and the oil case 5 to rotationally drive an output shaft 8*a* via a transmission mechanism 7.

A propeller 8 is connected to a rear end portion of the output shaft 8*a*. The drive shaft 6 driven by the engine 2 rotates the propeller 8 via the transmission mechanism 7. A hull is given propulsion by the rotation of the propeller 8.

The engine cover 9 is made from a resin material and covers upper and peripheral portions of the engine 2 in an enclosing manner. That is, the engine cover 9 covers a portion of the engine 2 above a vertically intermediate portion thereof.

A resin under cover 10 provided below the engine cover 9 covers a lower half portion of the engine 2 and the periphery of the mount case 4 housing the oil pump body.

An extension case 11 is connected to a lower portion of the oil case 5 to extend downward. The extension case 11 is formed from an aluminum alloy.

A gearbox 12 containing the transmission mechanism 7 is integrally provided to a lower portion of the extension case 11. The gearbox 12 is formed from an aluminum alloy.

The under cover 10 covers mating surfaces of the oil case 5 and the extension case 11.

The mount case 4 and surrounding portions are formed from metal such as an aluminum alloy.

A swivel shaft 13*a* is provided vertically between a front portion of the mount case 4 and a front portion of the extension case 11. The swivel shaft 13*a* is housed in a swivel case 13. A tilt shaft 14*a* supporting the outboard motor 1 in a vertically rotatable manner is provided at a stern bracket 14 connected to the swivel case 13. The stern bracket 14 is fixed to a stern. The outboard motor 1 is thus supported in a steerable and tiltable manner with respect to the stern.

An exhaust outlet 3*a* of the exhaust manifold 3 communicates with an exhaust pipe 16 integrally formed with the oil case 5 via a communicating opening 15 provided in the mount case 4. An exhaust passage is formed by the exhaust manifold 3, communicating opening 15 and exhaust pipe 16. The exhaust pipe 16 is located within the exhaust chamber 17*a*, extending downward adjacently to the rear of the oil pan 5*c*.

In a rear portion 4*a* of the mount case 4, a passage 19 communicating with the exhaust chamber 17*a* is provided. A proximal end portion of an exhaust outlet pipe 20 is connected to the passage 19 at the opposite side to the side of the exhaust chamber 17*a*. A distal end portion 20*a* of the exhaust outlet pipe 20 leads to the outside through an opening 10*a* formed in the under cover 10. That is, outside air and the exhaust chamber 17*a* communicate with one another through the passage 19 and the exhaust outlet pipe 20.

Therefore, when the exhaust pressure of the engine 2 is low, an exhaust gas is discharged through the exhaust outlet pipe 20 to the outside of the outboard motor 1. When the exhaust pressure of the engine 2 is high, an exhaust gas is discharged from the exhaust chamber 17*a* through the inside of the extension case 11 into water.

Figure 2:
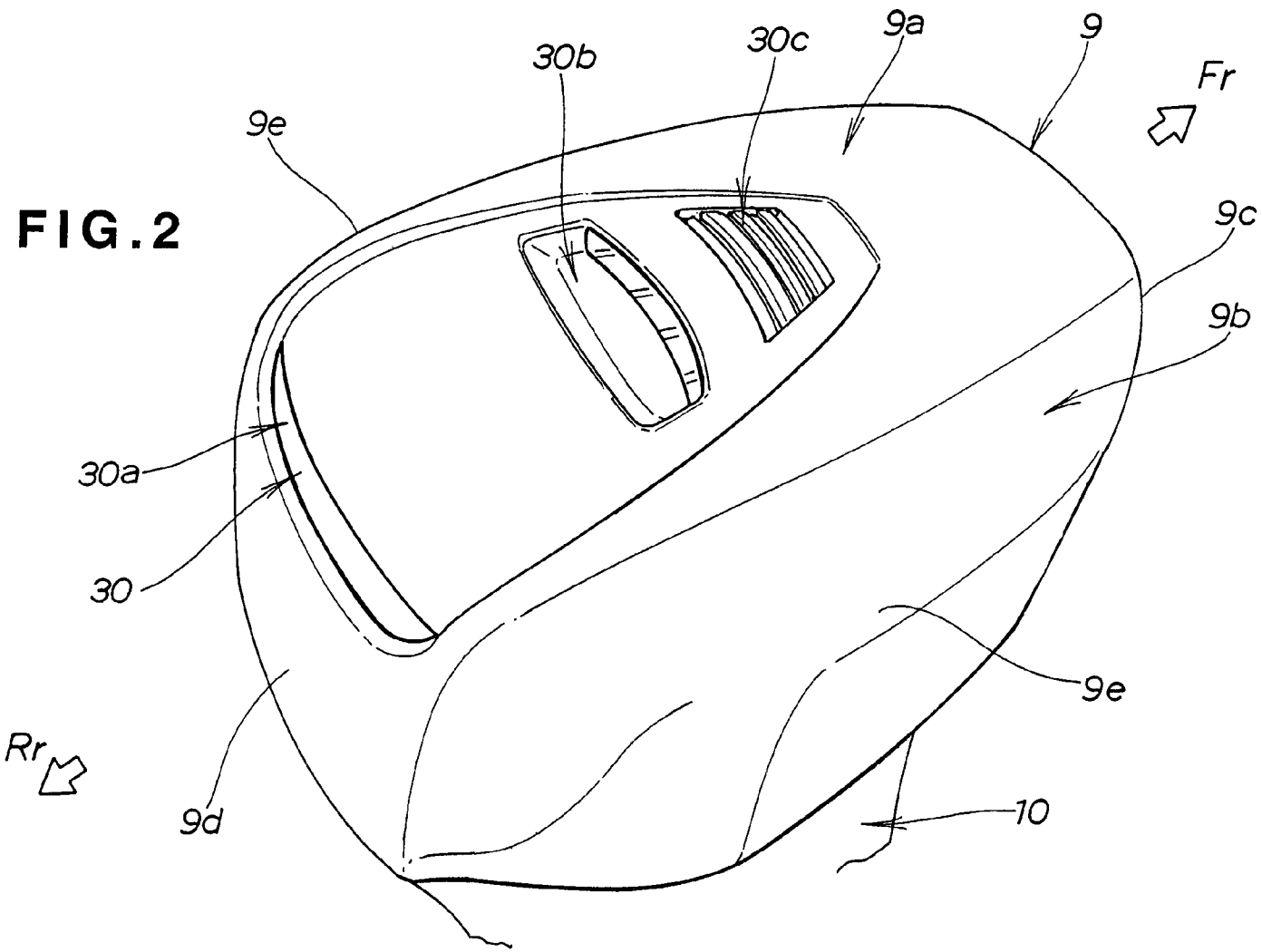
FIG. 2 is a perspective view of an engine cover shown in FIG. 1.

As shown in FIG. 2, the engine cover 9 is detachably connected to the top of the under cover 10. The engine cover 9 is comprised of a roof 9*a* formed with a slightly curved surface elongated fore and aft, and an outer peripheral wall 9*b* consisting of a front wall 9*c*, a rear wall 9*d* and left and right side walls 9*e*, 9*e*, shaped like a cap opening downward.

The engine cover 9 has an air inlet opening 30 formed in the roof 9*a* from a longitudinally substantially middle portion to a rear portion thereof. The air inlet opening 30 includes, in the illustrated embodiment, a laterally elongated first air inlet opening 30*a* formed in a rear end portion of the roof 9*a*, an upward opening second air inlet opening 30*b* formed in a longitudinally middle portion thereof, and a louvered third air inlet opening 30*c* formed forward of the second air inlet opening 30*b*.

Figure 3:
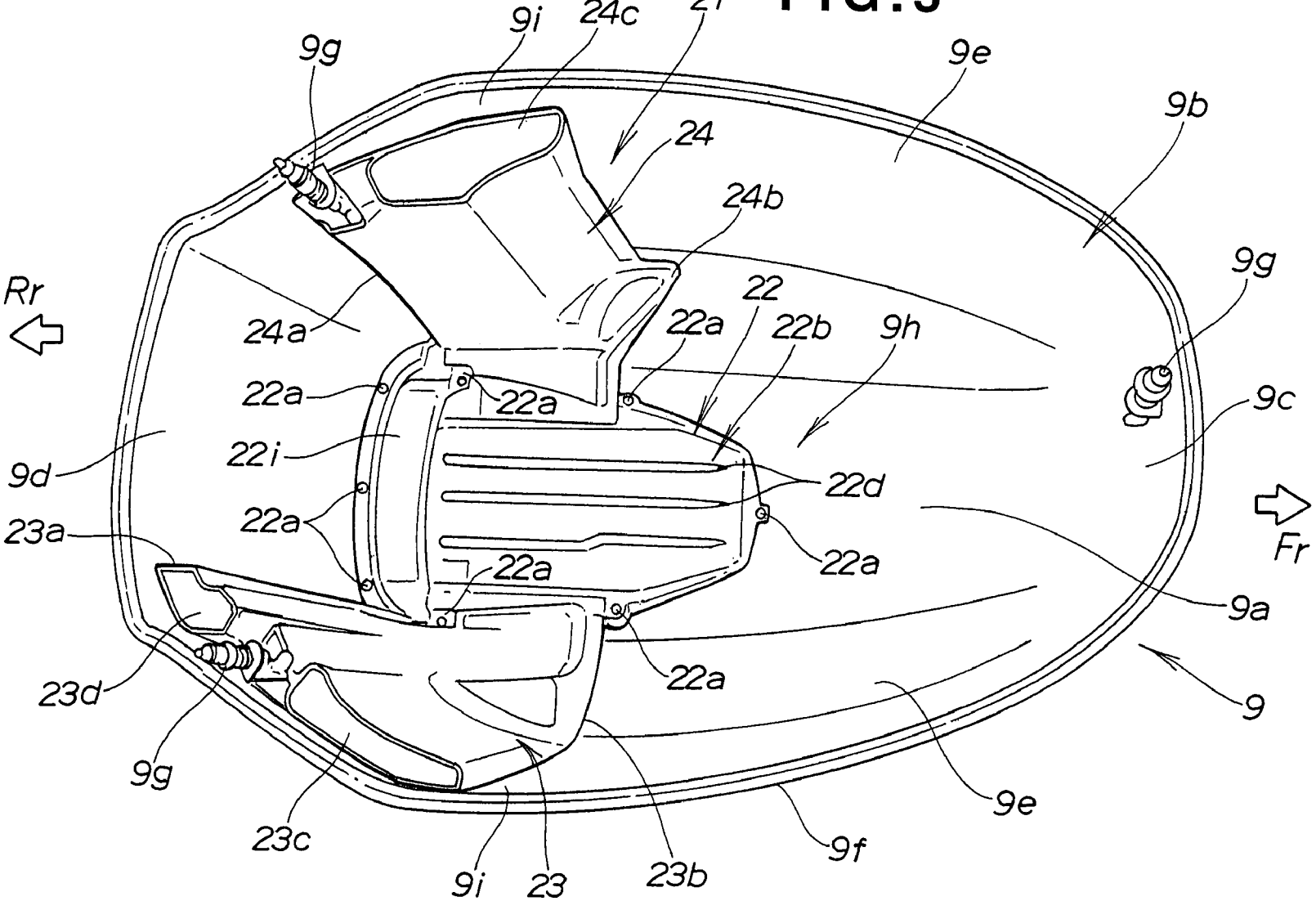
FIG. 3 is a bottom view of the engine cover shown in FIG. 2 provided with an intake passage unit.

As shown in FIG. 3, the engine cover 9 has a sealant 9*f* fitted to the bottom of the outer peripheral wall 9*b*. The front wall 9*c* internally has an engaging part 9*g* to engage a front inner portion of the under cover 10 shown in FIG. 1.

The intake passage unit 21 is fitted to a rear inner portion of the engine cover 9. The intake passage unit 21 includes a connecting portion 22 located at the top, and left and right intake passage portions 23, 24 provided in such a manner as to extend downward from the left and the right of the connecting potion 22. The connecting portion 22 and the left and right intake passage portions 23, 24 are integrally molded from a resin material.

The connecting portion 22 is provided at the front and rear and the left and right with a plurality of mounting bosses 22*a*. The connecting portion 22 is screwed at the mounting bosses 22*a* to a rear half portion of an inner surface 9*h* of the roof 9*a* of the engine cover 9.

Figure 9:
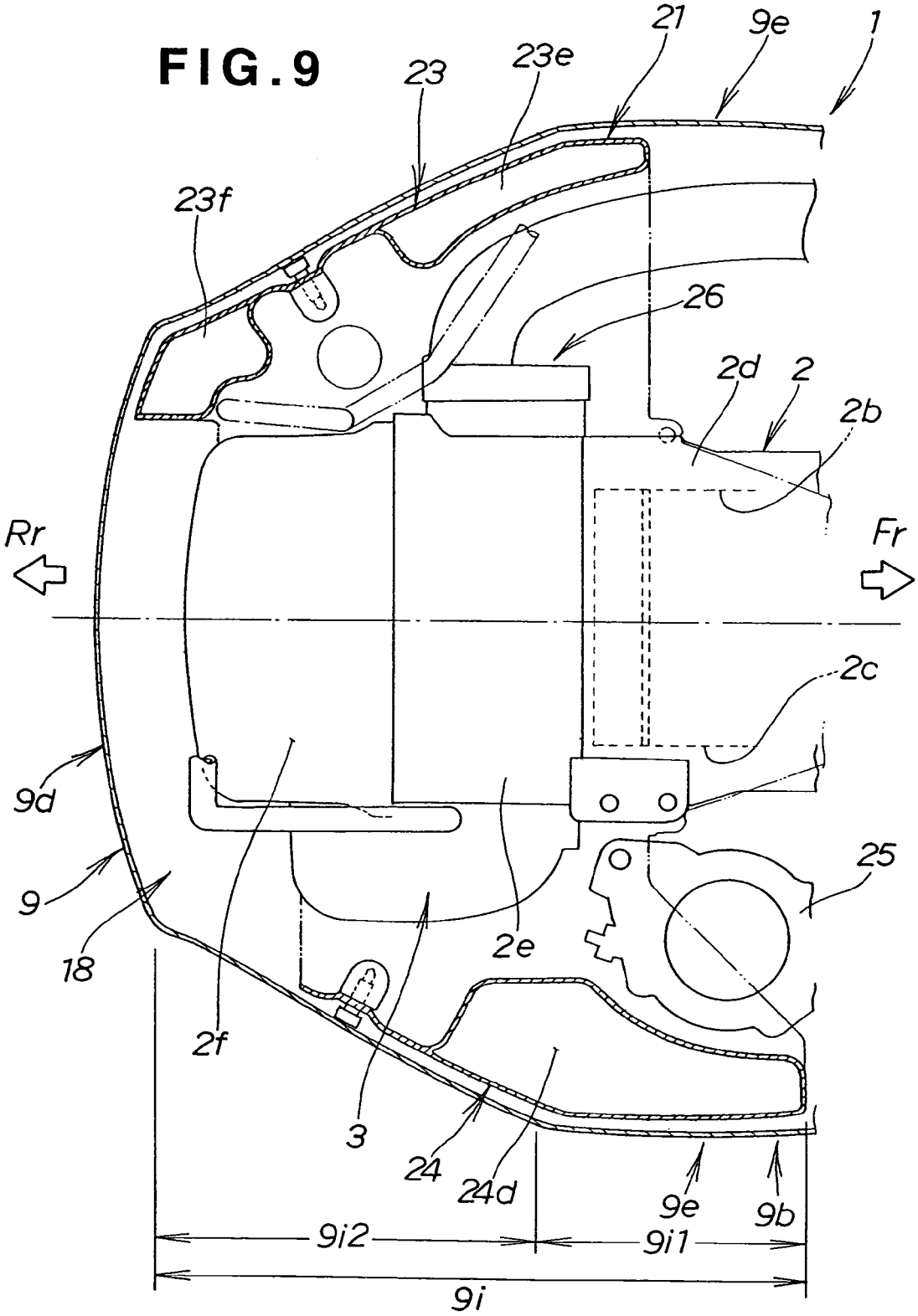
FIG. 9 is a horizontal cross-sectional view of FIG. 8.

The left and right intake passage portions 23, 24 are provided in such a manner as to extend vertically along rear inner surfaces 9*i*, 9*i* of the left and right side walls 9*e*, 9*e* of the engine cover 9. As shown in FIG. 9, each rear inner surface 9*i* is an area including a portion 9*i*1 of the side wall 9*i* at which the engine compartment 18 has the greatest width and a portion 9*i*2 of the side wall 9*i* extending from the portion 9*i*1, across the rear of the head cover 2*f*, to the vicinity of the rear wall 9*d*. The portion 9*i*2 has a flat shape linearly narrowed toward the rear.

FIGS. 4 to 7 illustrate the intake passage unit 21 removed from the engine cover 9.

Figure 7:
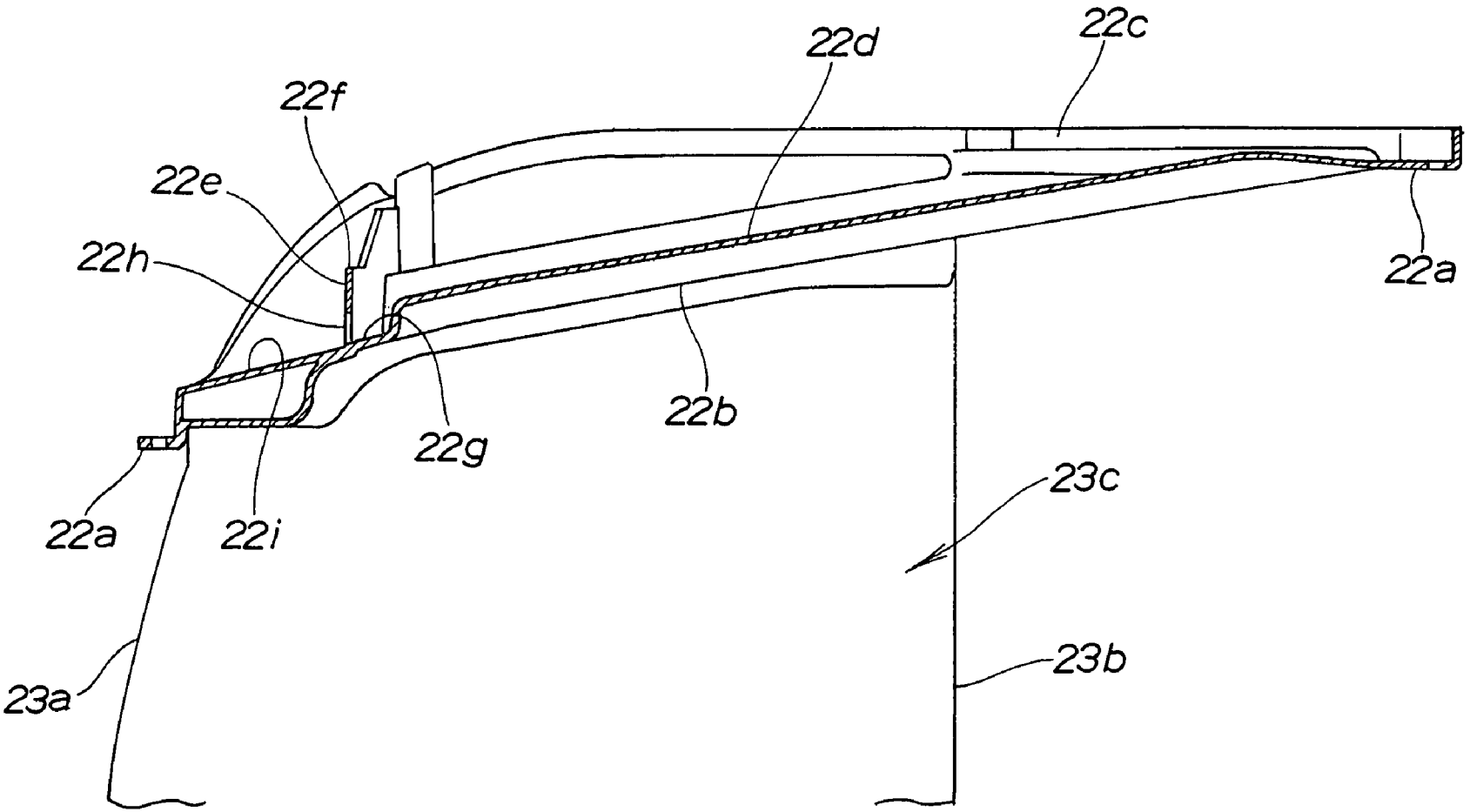
FIG. 7 is a cross-sectional view taken along line 7—7 in FIG. 5.

The intake passage unit 21 has an inverted U shape in a rear view and in a front view. The connecting portion 22 has a flat shape increased in width to the rear. A base 22*b* has a peripheral wall 22 integrally raised to surround the base 22*b*. The peripheral wall 22*c* has a low height. The base 22*b* slopes downward to the rear as shown in FIG. 7. The base 22*b* has on its top surface a plurality of ribs 22*d* provided in such a manner as to extend fore and aft in a laterally spaced relationship.

The peripheral wall 22*c* is designed in height to be lower at a front portion and higher at a rear portion. As is clear from FIG. 7, the base 22*b* slopes downward to the rear, so that the base 22*b* in its entirety including the peripheral wall 22*c* has generally the same fore-and-aft height.

A vertical wall 22*e* located at the rear of the peripheral wall 22*c* has a notched portion 22*f* formed by cutting an intermediate upper edge portion off for air intake. The vertical wall 22*e* is formed, in a portion below the notched portion 22*f*, with drain holes 22*h*, 22*h* communicating with a stepped portion 22*g* formed by lowering a rear portion of the base 22*b* as shown in FIG. 7.

Figure 8:
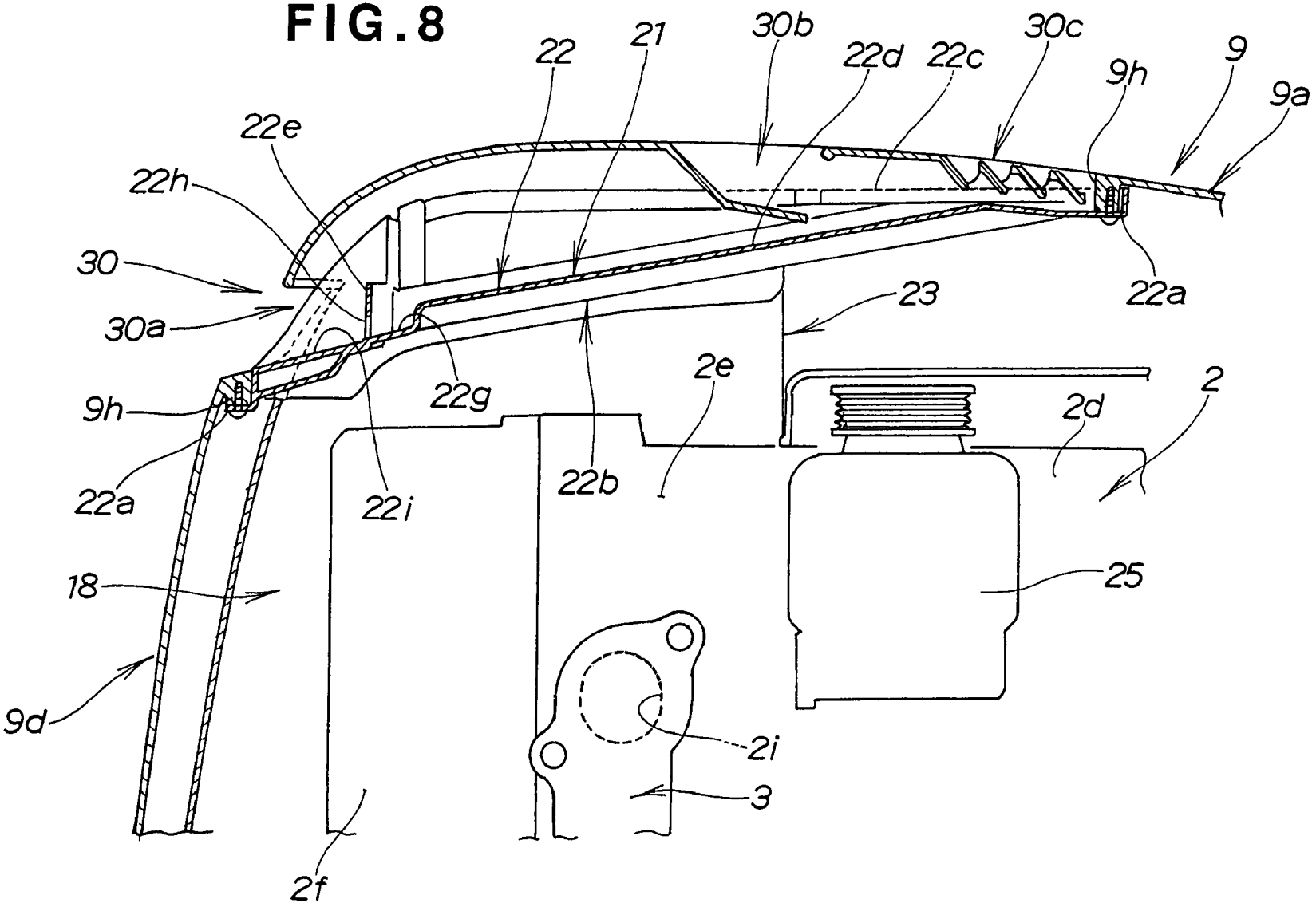
FIG. 8 is an enlarged cross-sectional view illustrating the connection between the rear of the engine cover and the intake passage unit.

The base 22*b* has a platform portion 22*i* extending rearward from the stepped portion 22*g* and bulging out in an arc shape at its rear edge. The platform portion 22*i* is provided at its arc-shaped rear end portion with a plurality of mounting bosses 22*a*. As shown in FIG. 8, the mounting bosses 22*a* are fixed to an inner portion of a rear end portion of the engine cover 9.

The vertically elongated tubular intake passage portions 23, 24 are integrally provided to the left and the right of the connecting portion 22.

Figure 4:
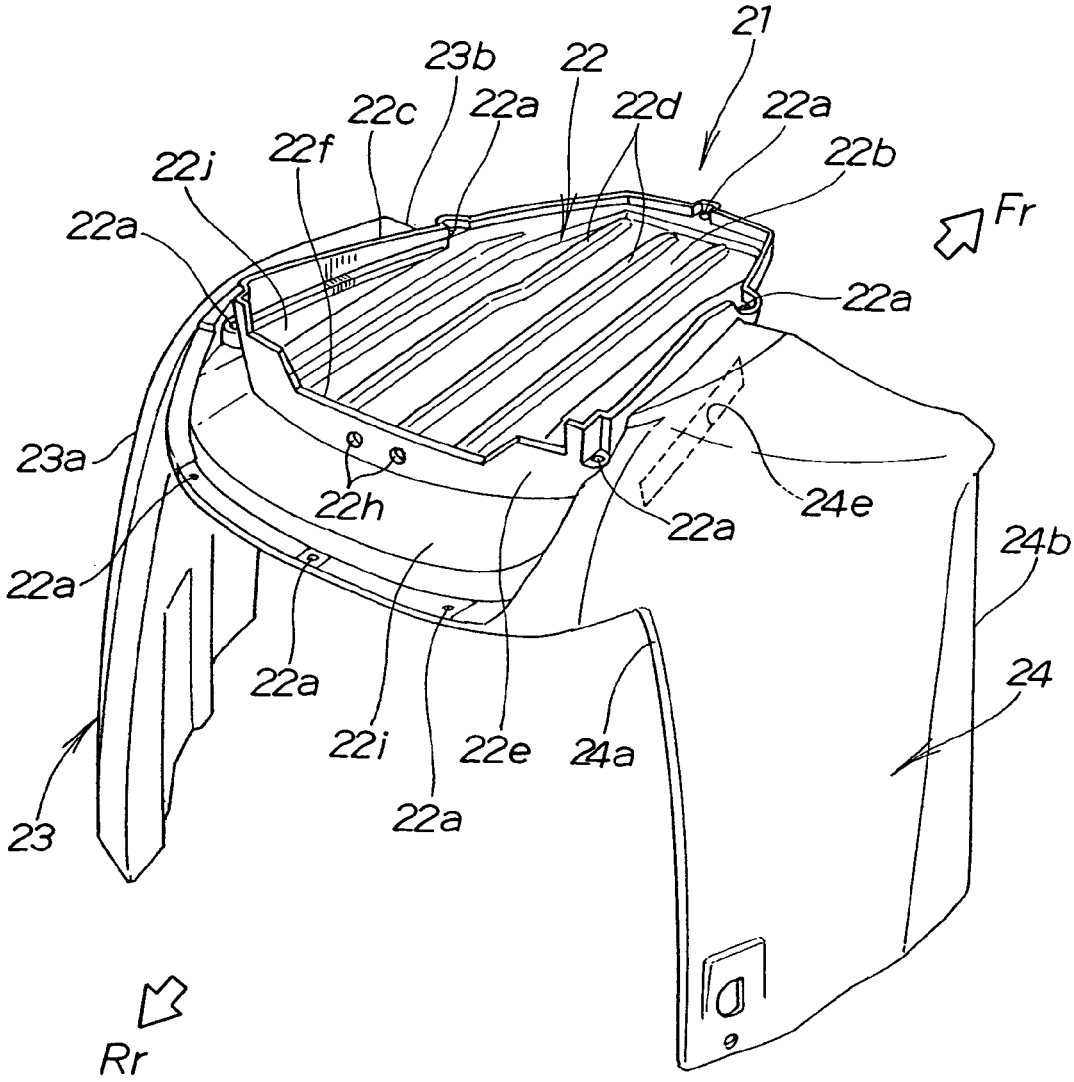
FIG. 4 is a perspective view of the intake passage unit shown in FIG. 3.
Figure 5:
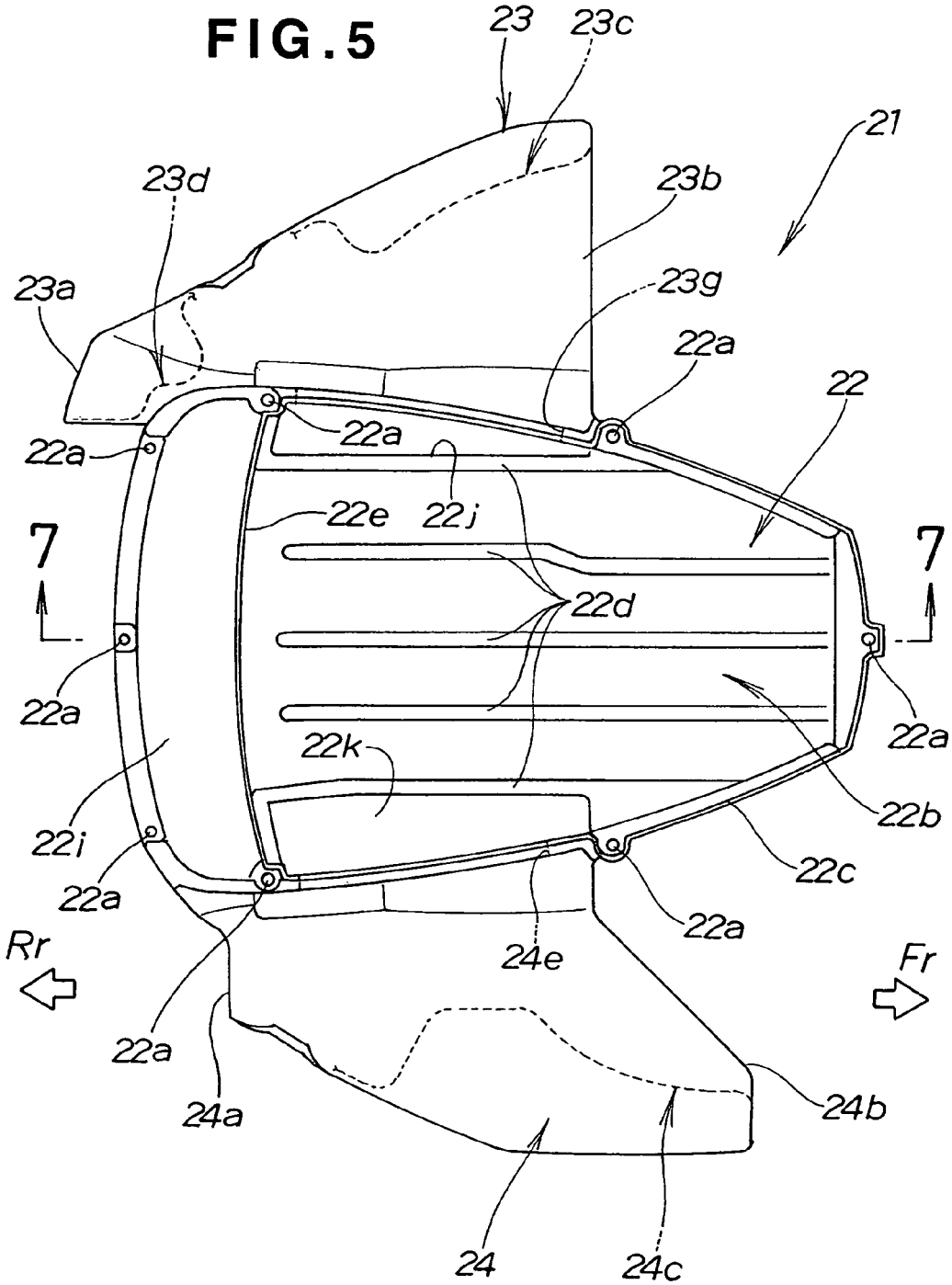
FIG. 5 is a plan view of the intake passage unit shown in FIG. 4.

As shown in FIGS. 4 and 5, a rear edge 23*a* of the left intake passage portion 23 protrudes slightly rearward of the rear edge of the platform portion 22*i*. A rear edge 24*a* of the right intake passage portion 24 is located slightly forward of the rear edge of the platform portion 22*i*. With respect to a front edge 23*b* of the left intake passage portion 23, a front edge 24*b* of the right intake passage portion 24 is located forward.

Figure 6:
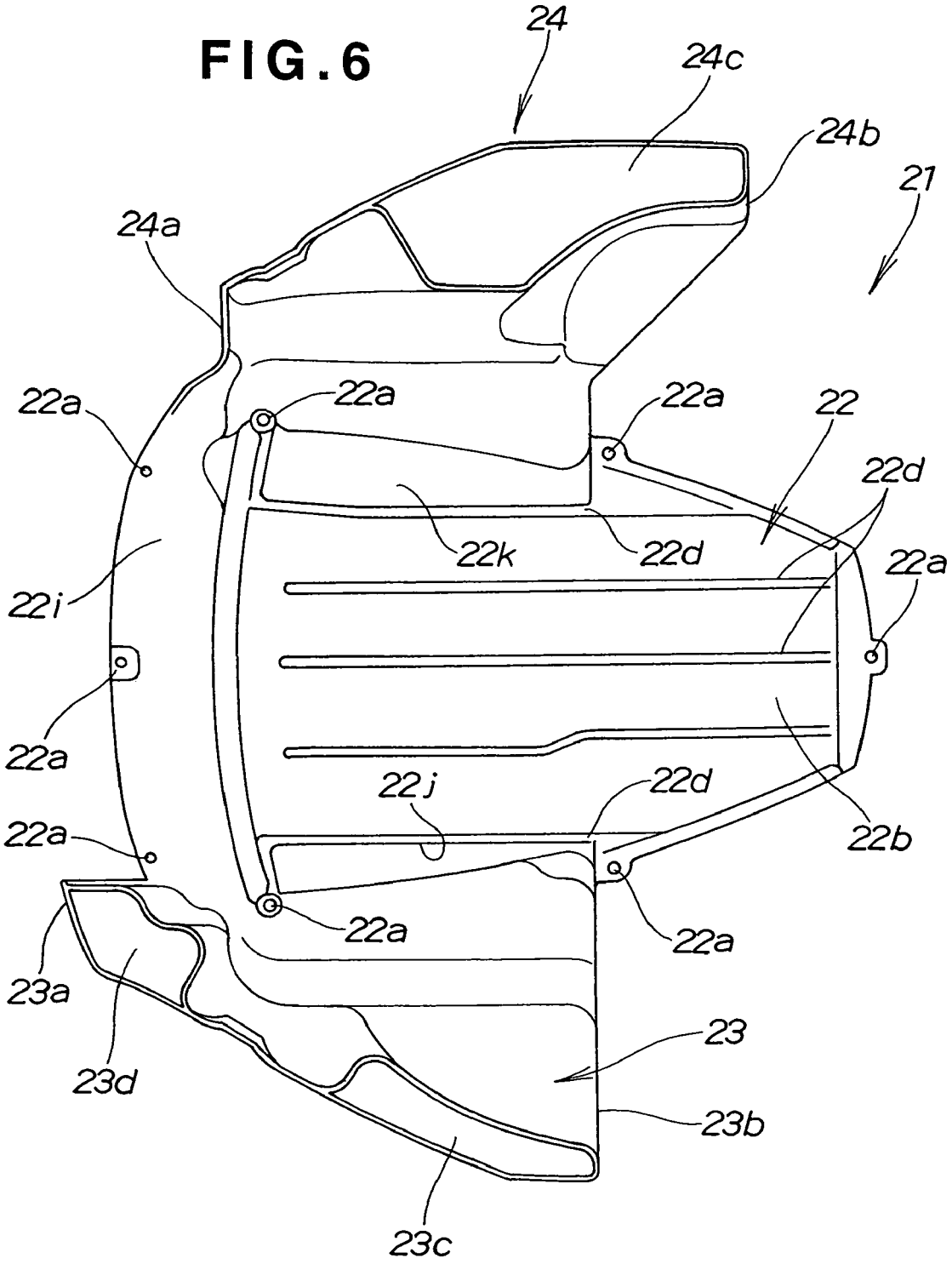
FIG. 6 is a bottom plan view of the intake passage unit shown in FIG. 4.

The left and right intake passage portions 23, 24 have lower openings 23*c*, 23*d* and 24*c* opening downward as shown in FIGS. 3 and 6. Passages formed in the left and right intake passage portions 23, 24 have flat shapes elongated fore and aft.

An inner passage including the lower openings 23*c*, 23*d* of the left intake passage portion 23 is narrow in width, and is divided into two at a lower portion, which are merged at an upper portion, forming a single upper opening 23*g* as shown in FIG. 5. The upper opening 23*g* communicates with a left opening 22*j* formed in the base 22*b* of the connecting portion 22.

The lower opening 24*c* of the right intake passage portion 24 has a larger width than the lower openings 23*c*, 23*d* of the left intake passage portion 23, and its inner passage also has a larger width. As shown in FIGS. 4 and 5, an upper opening 24*e* of the right intake passage portion 24 communicates with a right opening 22*k* formed in the base 22*b* of the connecting portion 22.

As shown in FIG. 3, engaging parts 9*g*, 9*g* to be engaged with rear inner portions of the under cover 10 shown in FIG. 1 are provided between the lower openings 23*c*, 23*d* of the left intake passage portion 23 and in the vicinity of the lower opening 24*c* of the right intake passage portion 24, respectively.

The left and right intake passage potions 23, 24 are integrally connected at their upper portions to the left and right of the base 22*b* of the connecting portion 22 to introduce air taken in through the air inlet opening 30 (30*a*, 30*b*, 30*c*) formed in the engine cover 9 (see FIGS. 2 and 8) into the engine compartment 18 via the left and right openings 22*j*, 22*k* formed in the base 22*b* of the connecting portion 22.

As shown in FIGS. 8 and 9, the intake passage unit 21 is provided such that the left and right intake passage portions 23, 24 are located at the rear of the engine 2, that is, at both the left and the right of the cylinder head cover 2*f*, the cylinder head 2*e* and the rear of the cylinder block 2*d* in the engine compartment 18.

The connecting portion 22 of the intake passage unit 21 is, as shown in FIG. 8, located below a rear portion of the roof 9*a* of the engine cover 9 with a small clearance held above a rear portion of the engine 2 so that the base 22*b* inclines downward to the rear. The first air inlet opening 30*a* is located rearward of the connecting portion 22. The second air inlet opening 30*b* is located above a middle portion of the connecting portion 22. The third air inlet opening 30*c* is located above a front portion of the connecting portion 22. In FIG. 8, reference numeral 25 denotes a generator.

As shown in FIGS. 1 and 9, part of air taken in through the passage 24*d* of the right intake passage portion 24 is used for cooling the generator 25 shown in FIG. 8.

As shown in FIG. 9, the left intake passage portion 23 is located between an intake manifold 26 of the engine 2 and the rear inner surface 9*i* of the left side wall 9*e* of the engine cover 2. The vertically extending two passages 23*e*, 23*f* separated in a fore-and-aft direction merge at their upper portions to constitute the single upper opening 23.

The right intake passage portion 24 is located between the exhaust manifold 3 and the rear inner surface 9*i* of the right side wall 9*e* of the engine cover 9. The passage 24*d* extends vertically.

As is clear from FIGS. 9, 1 and 8, the left and right intake passage portions 23, 24 overlap the sides of the engine 2 in a side view, and the right intake passage portion 24 is located forward of the rear end portion of the engine 2.

Since the base 22*b* inclines downward to the rear as shown in FIG. 8, if water enters the connecting portion 22 from above the base plate 22*b* through the second air inlet opening 30*b* and the third air inlet opening 30*c*, the entering water is prevented from moving laterally over the base 22*b* by the peripheral wall 22*c* surrounding the base 22*b*, and flows rearward to be discharged outside through the drain holes 22*h*, 22*h* formed in the vertical wall 22*e* of the peripheral wall 22*c*. If water enters the intake system with air, ingress of water into the engine compartment 18 can be prevented.

Figure 10:
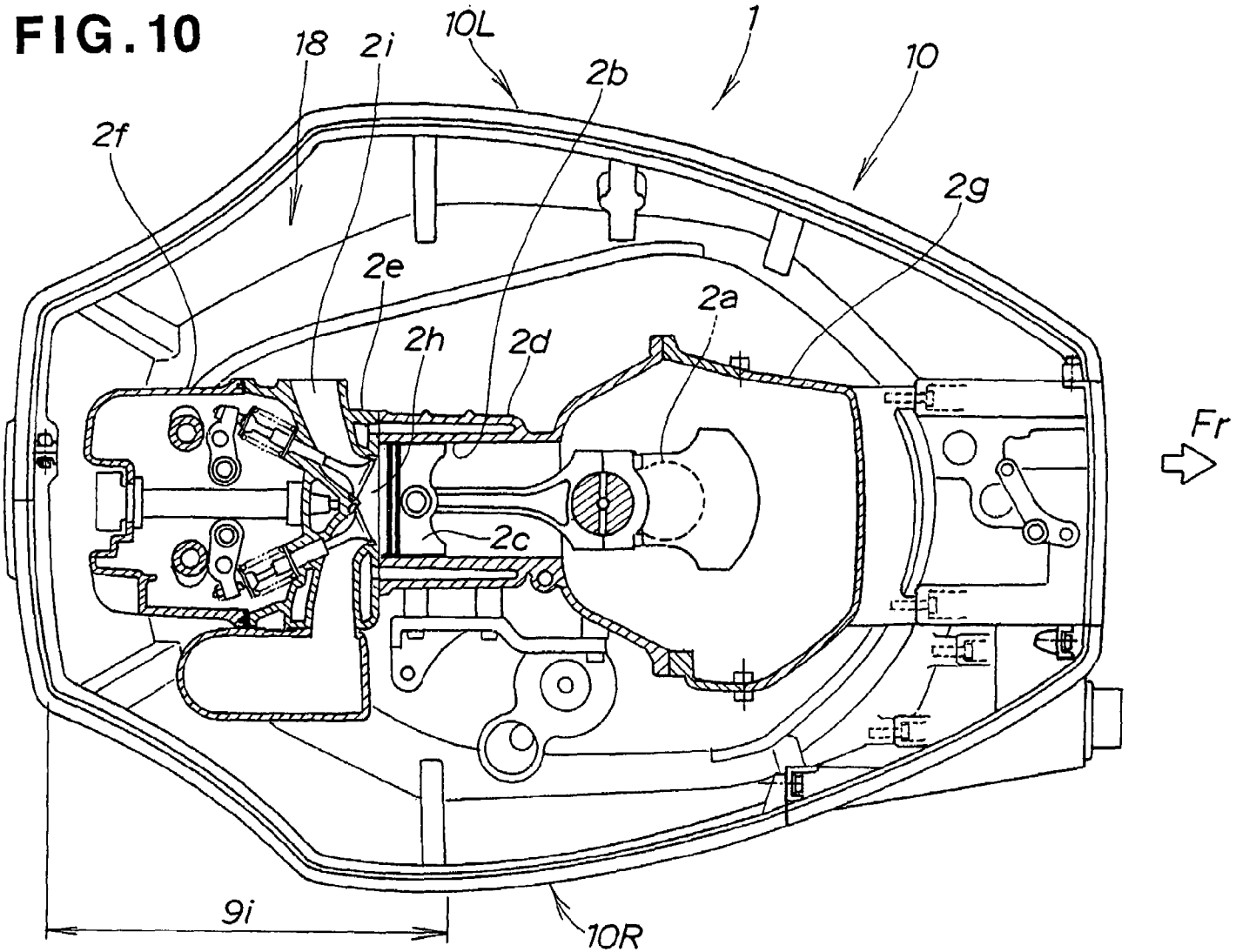
FIG. 10 is a plan view, in part in cross section, of the outboard motor with the engine cover removed.

In FIG. 10, a plane configuration within the engine compartment 18 can be seen. FIG. 10 illustrates the inside of the engine compartment 18 formed by the under cover 10 with the engine cover 9 removed, in which the cylinder axis is oriented in a fore-and-aft direction.

The under cover 10 is configured with left and right cover halves 10L, 10R joined together. It is illustrated that the rear inner surface 9*i* of the engine cover 9 is a fore-and-aft area.

The present embodiment has been described above with the example of dividing a large part of the passage of the passage portion 23, including an opening, into front and rear two portions, but it may alternatively be formed with a single flat passage. Also, the cross-sectional shapes of the left and right passage portions 23, 24 may be changed according to the arrangement and configuration of the engaging parts 9*g* of the engine cover 9 and the opposite side shapes of the engine rear portion.

Obviously, various minor changes and modifications of the present invention are possible in the light of the above teaching. It is therefore to be understood that within the scope of the appended claims the invention may be practice otherwise than as specifically described.

What is claimed is:

1. An outboard motor, comprising:

an engine;

an engine cover defining at least a part of an engine compartment housing the engine, the engine cover having at least one air introduction opening for taking air into the engine compartment; and an intake passage unit provided within the engine compartment and having a base and left and right passage portions connected to the base and communicating with the air introduction opening, the left and right passage portions extending vertically downwardly from the base along left and right sides, respectively, of the engine, the left and right passage portions overlapping the engine in a side view, and rear edges of the left and right passage portions being located forward of a rear inner surface of the engine cover.

2. An outboard motor as set forth in claim 1; wherein the rear edge of one passage portion of the left and right passage portions is located forward of a rear edge of the engine.

3. An outboard motor as set forth in claim 1; wherein the left and right passage portions have tubular shapes and are connected at upper portions thereof to, and communicate with, the at least one air introduction opening.

4. An outboard motor as set forth in claim 1; wherein plane cross sections of the left and right passage portions have flat shapes elongated in a fore-and-aft direction of the engine cover.

5. An outboard motor as set forth in claim 1; wherein the engine is an in-line engine with center lines of cylinders oriented in a fore-and-aft direction.

6. An outboard motor comprising: an engine cover defining at least part of an engine compartment and having one or more air introduction openings for intaking air into the engine compartment; an engine disposed within the engine compartment; and an intake passage unit disposed within the engine cover and communicating with the one or more air introduction openings for delivering air into the engine compartment, the intake passage unit having left and right passage portions extending downwardly in the engine compartment along left and right sides, respectively, of the engine for delivering air into the engine compartment, one of the left and right passage portions having an upper passage portion connected to and communicating with two lower passage portions that terminate in openings that open in the engine compartment.

7. An outboard motor comprising: an engine cover defining at least part of an engine compartment and having one or more air introduction openings for intaking air into the engine compartment; an engine disposed within the engine compartment; and an intake passage unit disposed within the engine cover and communicating with the one or more air introduction openings for delivering air into the engine compartment, the intake passage unit having left and right passage portions extending downwardly in the engine compartment along left and right sides, respectively, of the engine for delivering air into the engine compartment, one of the left and right passage portions extending downwardly along an intake manifold of the engine and the other of the left and right passage portions extending downwardly along an exhaust manifold of the engine.

8. An outboard motor according to claim 7; wherein the left and right passage portions have tubular shapes.

9. An outboard motor according to claim 7; wherein one of the left and right passage portions has an upper passage portion connected to and communicating with two lower passage portions that terminate in openings that open in the engine compartment.

10. An outboard motor according to claim 9; wherein the intake passage unit comprises an integrally molded unit.

* * * * *